US005881706A

United States Patent [19]

Carson

[11] Patent Number: 5,881,706

[45] Date of Patent: Mar. 16, 1999

[54] TOY ROCKET LAUNCHER

[76] Inventor: William C. Carson, 4262 Agate Cir., Cypress, Calif. 90630

[21] Appl. No.: 146,497

[22] Filed: Sep. 3, 1998

[51] Int. Cl.[6] ..... F41B 11/00

[52] U.S. Cl. ..... 124/69; 124/70; 124/1; 446/56; 446/212

[58] Field of Search ..... 124/69, 70, 1; 446/56, 211, 212

[56] References Cited

U.S. PATENT DOCUMENTS

| | | | |
|---|---|---|---|
| D. 248,498 | 7/1978 | Kambayashi | D21/1 |
| 3,046,694 | 7/1962 | Holderer | 46/74 |
| 3,785,083 | 1/1974 | Pippin, Jr. | 124/69 |
| 4,223,472 | 9/1980 | Fekete et al. | 46/44 |
| 5,188,557 | 2/1993 | Brown | 446/212 |
| 5,381,778 | 1/1995 | O'Andrade et al. | 124/69 |
| 5,415,153 | 5/1995 | Johnson et al. | 124/63 |
| 5,653,216 | 8/1997 | Johnson | 124/69 |

*Primary Examiner*—J. Woodrow Eldred

[57] ABSTRACT

A toy rocket launcher for launching a common bottle such as a plastic two liter beverage bottle in the air with pneumatic pressure. The toy rocket launcher includes a support stand having a top member and a plurality of support legs downwardly depending from the top member. The top member has a hole through which the upper end of a conduit is upwardly extended. An end of a hose is coupled to a lower end of the conduit to fluidly connect the hose to the conduit. A pneumatic pump is attached to a second end of the hose for pumping air into the hose. The upper end of the conduit is inserted into an opening in the neck of an inverted beverage bottle.

10 Claims, 2 Drawing Sheets

TOY ROCKET LAUNCHER

BACKGROUND OF THE INVENTION

1. Field of the Invention

The present invention relates to toy rocket launchers and more particularly pertains to a new toy rocket launcher for launching a common bottle such as a plastic two liter beverage bottle in the air with pneumatic pressure.

2. Description of the Prior Art

The use of toy rocket launchers is known in the prior art. More specifically, toy rocket launchers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,918,751; U.S. Pat. No. 5,415,153; U.S. Pat. No. Des. 248,498; U.S. Pat. No. 3,962,818; U.S. Pat. No. 4,573,434; and U.S. Pat. No. 5,197,452.

While these devices fulfill their respective, particular objectives and requirements, the aforementioned patents do not disclose a new toy rocket launcher. The inventive device includes a support stand having a top member and a plurality of support legs downwardly depending from the top member. The top member has a hole through which the upper end of a conduit is upwardly extended. An end of a hose is coupled to a lower end of the conduit to fluidly connect the hose to the conduit. A pneumatic pump is attached to a second end of the hose for pumping air into the hose. The upper end of the conduit is inserted into an opening in the neck of an inverted beverage bottle.

In these respects, the toy rocket launcher according to the present invention substantially departs from the conventional concepts and designs of the prior art, and in so doing provides an apparatus primarily developed for the purpose of launching a common bottle such as a plastic two liter beverage bottle in the air with pneumatic pressure.

SUMMARY OF THE INVENTION

In view of the foregoing disadvantages inherent in the known types of toy rocket launchers now present in the prior art, the present invention provides a new toy rocket launcher construction wherein the same can be utilized for launching a common bottle such as a plastic two liter beverage bottle in the air with pneumatic pressure.

The general purpose of the present invention, which will be described subsequently in greater detail, is to provide a new toy rocket launcher apparatus and method which has many of the advantages of the toy rocket launchers mentioned heretofore and many novel features that result in a new toy rocket launcher which is not anticipated, rendered obvious, suggested, or even implied by any of the prior art toy rocket launchers, either alone or in any combination thereof.

To attain this, the present invention generally comprises a support stand having a top member and a plurality of support legs downwardly depending from the top member. The top member has a hole through which the upper end of a conduit is upwardly extended. An end of a hose is coupled to a lower end of the conduit to fluidly connect the hose to the conduit. A pneumatic pump is attached to a second end of the hose for pumping air into the hose. The upper end of the conduit is inserted into an opening in the neck of an inverted beverage bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy rocket launcher apparatus and method which has many of the advantages of the toy rocket launchers mentioned heretofore and many novel features that result in a new toy rocket launcher which is not anticipated, rendered obvious, suggested, or even implied by any of the prior art toy rocket launchers, either alone or in any combination thereof.

It is another object of the present invention to provide a new toy rocket launcher which may be easily and efficiently manufactured and marketed.

It is a further object of the present invention to provide a new toy rocket launcher which is of a durable and reliable construction.

An even further object of the present invention is to provide a new toy rocket launcher which is susceptible of a low cost of manufacture with regard to both materials and labor, and which accordingly is then susceptible of low prices of sale to the consuming public, thereby making such toy rocket launcher economically available to the buying public.

Still yet another object of the present invention is to provide a new toy rocket launcher which provides in the apparatuses and methods of the prior art some of the advantages thereof, while simultaneously overcoming some of the disadvantages normally associated therewith.

Still another object of the present invention is to provide a new toy rocket launcher for launching a common bottle such as a plastic two liter beverage bottle in the air with pneumatic pressure.

Yet another object of the present invention is to provide a new toy rocket launcher which includes a support stand having a top member and a plurality of support legs downwardly depending from the top member. The top member has a hole through which the upper end of a conduit is upwardly extended. An end of a hose is coupled to a lower end of the conduit to fluidly connect the hose to the conduit. A pneumatic pump is attached to a second end of the hose for pumping air into the hose. The upper end of the conduit is inserted into an opening in the neck of an inverted beverage bottle.

Still yet another object of the present invention is to provide a new toy rocket launcher that can be easily manufactured with items readily available at a hardware store.

Even still another object of the present invention is to provide a new toy rocket launcher that provides a safe and exciting form of entertainment with a used plastic beverage bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
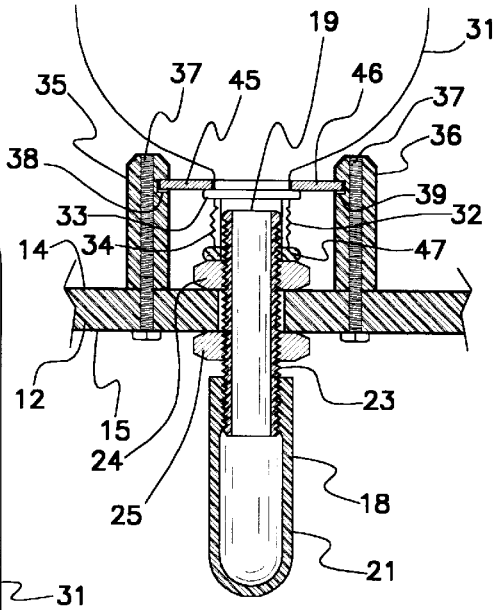
FIG. 2 is a schematic cross sectional view of the present invention.
Figure 1:
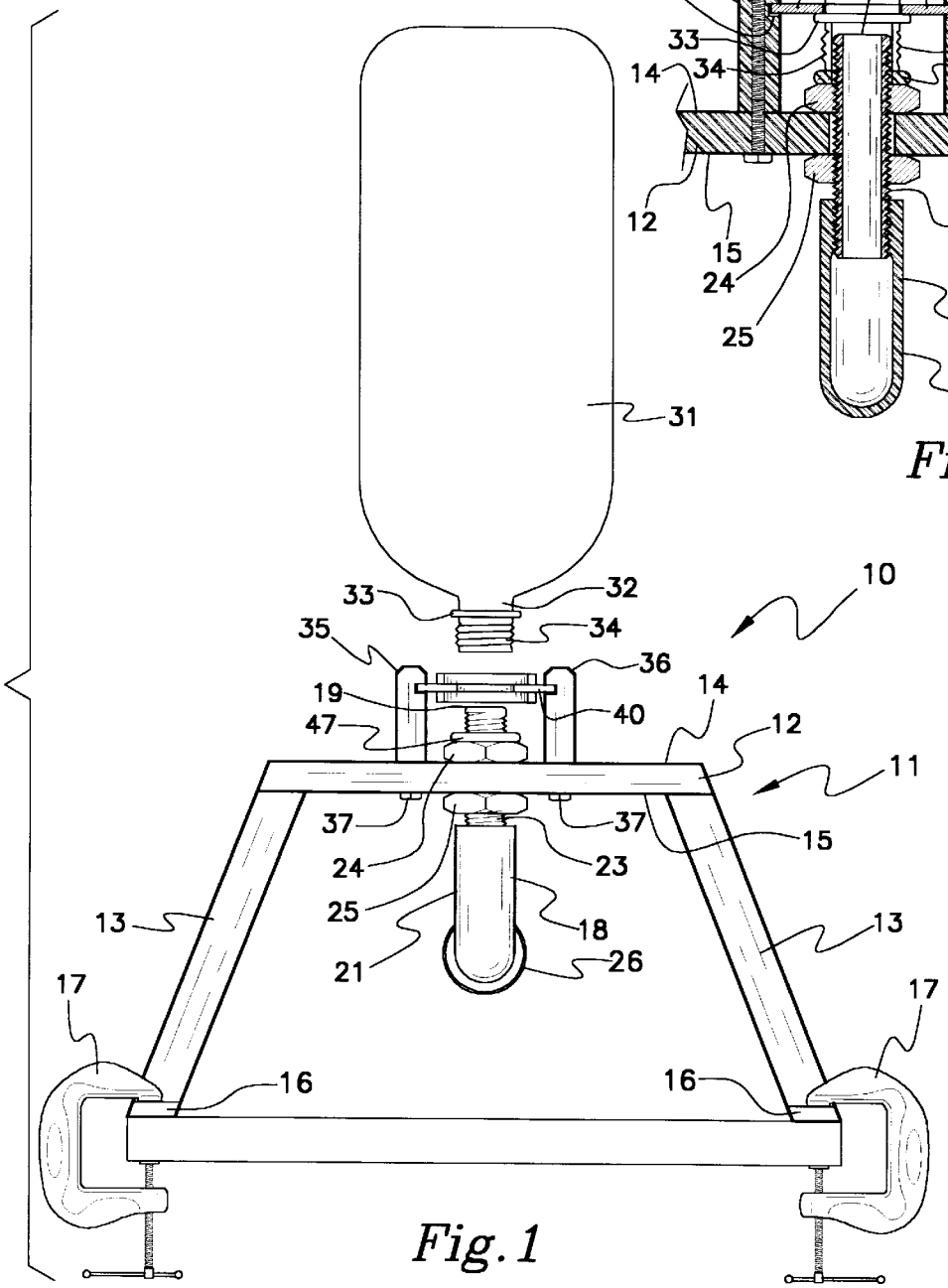
FIG. 1 is a schematic side view of a new toy rocket launcher according to the present invention.
Figures 3, 4, 5, 6:
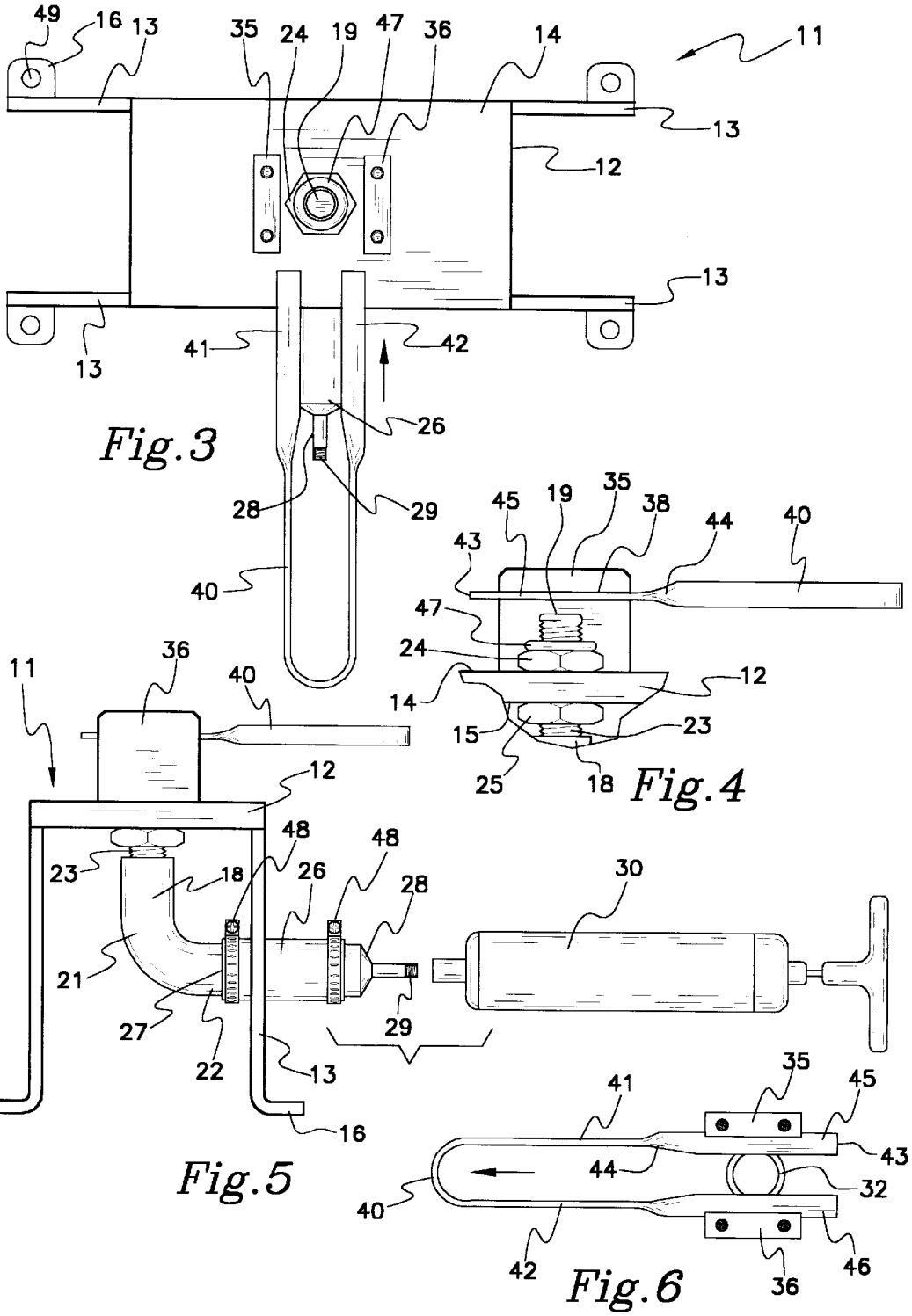
FIG. 3 is a schematic top view of the present invention.
FIG. 4 is a schematic side view of the area around the upper end of the conduit of the present invention.
FIG. 5 is another schematic side view of the present invention.
FIG. 6 is a schematic top view of the pincer bar holding the neck of the beverage bottle to the conduit.

With reference now to the drawings, and in particular to FIGS. 1 through 6 thereof, a new toy rocket launcher embodying the principles and concepts of the present invention and generally designated by the reference numeral 10 will be described.

As best illustrated in FIGS. 1 through 6, the toy rocket launcher 10 generally comprises a support stand 11 having a top member 12 and a plurality of support legs 13 downwardly depending from the top member 12. The top member 12 has a hole through which the upper end 19 of a conduit 18 is upwardly extended. An end 27 of a hose 26 is coupled to a lower end 20 of the conduit 18 to fluidly connect the hose 26 to the conduit 18. A pneumatic pump 30 is attached to a second end 28 of the hose 26 for pumping air into the hose 26. The upper end 19 of the conduit 18 is inserted into an opening in the neck 32 of an inverted beverage bottle 31.

In closer detail, the support stand 11 is designed for resting on a surface and has a generally planar top member 12 and a plurality of support legs 13 downwardly depending from the top member 12 for supporting the top member 12 generally vertical about the surface. The top member 12 of the support stand 11 is generally rectangular and has generally planar upper and lower surfaces 14,15, and a plurality of corners with a support leg 13 positioned adjacent each corner of the top member 12. Each of the support legs 13 has a longitudinal axis preferably extending at an obtuse angle from the plane the top member 12 lies in. Each of the support legs 13 preferably terminates at a lower foot tab 16 designed for resting on a surface. Each lower foot tab 16 is designed for clamping to the surface by C-shaped clamps 17. Each lower foot tab 16 has a hole 49 therethrough designed for extending a fastener therethrough to secure the lower foot tab to the surface.

The tubular conduit 18 has open upper and lower ends 19,20. The conduit 18 is preferably generally L-shaped (such as an elbow PVC pipe piece) and has upper and lower portions 21,22. The upper and lower portions 21,22 of the conduit 18 each have a longitudinal axis extending generally perpendicular to one another so that the lower end 20. The conduit 18 has a threaded region 23 adjacent the upper end 19 of the conduit 18.

The top member 12 has a centrally positioned hole therethrough. The hole of the top member 12 has a generally circular periphery. The upper end 19 of the conduit 18 is upwardly extended through the hole of the top member 12 from the lower surface 15 of the top member 12 such that the upper end 19 of the conduit 18 upwardly extends from the upper surface 14 of the top member 12 and the lower end 20 of the conduit 18 is positioned below the top member 12. A pair of threaded nuts 24,25 are threaded on to the threaded region 23 of the conduit 18 so that the top member 12 is interposed between the threaded nuts 24,25 with one threaded nut adjacent the upper surface 14 of the top member 12 and the other threaded nut adjacent the lower surface 15 of the top member 12 to couple the conduit 18 to the top member 12.

The flexible rubber hose 26 has a pair of open ends 27,28. A first of the ends 27 of the hose 26 is coupled to the lower end 20 of the conduit 18 to fluidly connect the hose 26 to the conduit 18 by inserting the lower end 20 of the conduit 18 into the one end of the hose 26 and clamping the conduit 18 and hose 26 together with a pair of hose clamps 28. In the preferred embodiment, the lower portion 22 of the conduit 18 extends in a laterally outwards direction from the top member 12 to provide easier user access to the hose 26. A second of the ends 28 of the hose 26 has a valve 29 for selectively opening and closing the second end 28 of the hose 26. Preferably, the valve 29 comprises a Schraeder-type valve. A pneumatic hand pump 30 is detachably attached to the valve 29 of the second end 28 of the hose 26 for pumping air into through the hose 26.

A beverage bottle 31 (such as a two liter beverage bottle) is provided with a neck 32 terminating at an opening into the beverage bottle 31. The neck 32 of the beverage bottle 31 has an annular lip 33 extending radially outwards therearound next to a threaded portion 34 located adjacent the opening of the neck 32. The upper end 19 of the conduit 18 is removably inserted into the opening of the neck 32 of the beverage bottle 31 such that the interior of the beverage bottle 31 is in fluid communication with the interior of the conduit 18.

A pair of spaced apart cleats 35,36 upwardly extend from the upper surface 14 of the top member 12 with the hole of the top member 12 interposed between the cleats 35,36 such that the upper end 19 of the conduit 18 is located between the cleats 35,36. Preferably, a pair of threaded fasteners 37 (such as a screw) couple the cleats 35,36 to the top member 12 with one threaded fastener extending into the top member and one of the cleats and another threaded fastener extending into the top member and another cleat. Each of the cleats 35,36 has an elongate groove 38,39 with the grooves 38,39 of the cleats 35,36 facing one another. The grooves 38,39 have longitudinal axes generally parallel to one another and lying in a plane positioned above the upper end 19 of the conduit 18 and the annular lip 33 of the neck 32 of the beverage bottle 31 and generally parallel to the upper surface 14 of the top member 12.

A generally U-shaped pincer bar 40 having a pair of spaced apart arms 41,42 each terminating at a free end 43. Ideally, the pincer bar 40 initially comprises a rectangular metal bar with a length of about 24 inches long and has a ½" width and a ¼" thickness that is bent into a U-shape. Each of the arms 41,42 of the pincer bar 40 has a twist 44 forming a generally planar end portion 45,46 between the twist 44 and free end 43 of the respective arm 41,42 of the pincer bar 40 with the end portions 45,46 of the arms 41,42 lie in a generally common plane. Each end portion 45,46 has a length defined between the associated twist 44 and free end 43 of the respective arm 41,42. The lengths of the end portions 45,46 of the arms 41,42 are preferably generally equal to one another. In an ideal embodiment, the length of each of the end portions 45,46 of the arms 41,42 is about 6 inches.

The arms 41,42 of the pincer bar 40 are extended between the cleats 35,36. The end portions 45,46 are inserted into the grooves 38,39 of the cleats 35,36 to hold the neck 32 of the beverage bottle 31 to the upper end 19 of the conduit 18. Specifically, one of the end portions is inserted into one of the grooves and another of the end portions is inserted into another of the grooves. The lip 33 of the neck 32 of the beverage bottle 31 is positioned between the end portions 45,46 and the top member 12 adjacent the end portions 45,46 such that the end portions 45,46 of the pincer bar 40 hold the neck 32 of the beverage bottle 31 to upper end 19 of the conduit 18.

Preferably, an annular washer 47 is disposed around the upper end 19 of the conduit 18 and interposed between the neck 32 of the beverage bottle 31 and the one threaded nut 24,25 to provide a generally air tight seal between the conduit 18 and the beverage bottle 31. Ideally, the washer 47 comprises a resiliently compressible material such as rubber or leather.

In use, the beverage bottle 31 is partially filled with water and the inverted to insert the upper end 19 of the conduit 18 into the opening of the neck 32 of the beverage bottle 31. The end portions 45,46 of the pincer bar 40 are then inserted into the grooves 38,39 of the cleats 35,36 to hold the beverage bottle 31 to the upper end 19 of the conduit 18. Next, air is pumped by the hand pump 30 through the conduit 18 into the beverage bottle 31 to increase the air pressure in the beverage bottle 31. After sufficient air has been pumped in, the end portions 45,46 are slid out of the grooves 38,39 to release the beverage bottle 31 from the upper end 19 of the conduit 18 so that the beverage bottle 31 is propelled upwards from the release of the pressure in the beverage bottle 31 through the opening of the neck 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy rocket launcher, comprising:

a support stand having a top member and a plurality of support legs downwardly depending from said top member;

said top member having a hole therethrough;

a conduit having open upper and lower ends;

said upper end of said conduit being upwardly extended through said hole of said top member such that said upper end of said conduit upwardly extends from said top member and said lower end of said conduit is positioned below said top member;

a flexible hose having a pair of open ends, a first of said ends of said hose being coupled to said lower end of said conduit to fluidly connect said hose to said conduit;

a second of said ends of said hose having a valve for selectively opening and closing said second end of said hose;

a pneumatic pump being attached to said second end of said hose for pumping air into said hose;

a beverage bottle having a neck terminating at an opening into said beverage bottle; and said upper end of said conduit being inserted into said opening of said neck of said beverage bottle.

2. The toy rocket launcher of claim 1, wherein each of said support legs terminates at a lower foot tab adapted for resting on a surface.

3. The toy rocket launcher of claim 2, wherein each lower foot tab has a hole therethrough adapted for extending a fastener therethrough to secure the lower foot tab to the surface.

4. The toy rocket launcher of claim 1, wherein said conduit is generally L-shaped and has upper and lower portions, said upper and lower portions of said conduit each having a longitudinal axis extending generally perpendicular to one another.

5. The toy rocket launcher of claim 1, wherein said conduit has a threaded region adjacent said upper end of said conduit, wherein a pair of threaded nuts are threaded on to said threaded region of said conduit, said top member being interposed between said threaded nuts such that said conduit is coupled to said top member.

6. The toy rocket launcher of claim 1, wherein said neck of said beverage bottle has an annular lip extending radially outwards therearound.

7. The toy rocket launcher of claim 6, wherein a pair of spaced apart cleats upwardly extend from said top member, said hole of said top member being interposed between said cleats such that said upper end of said conduit is located between said cleats, wherein each of said cleats has an elongate groove, said grooves of said cleats facing one another.

8. The toy rocket launcher of claim 7, further comprising a pincer bar being generally U-shaped and having a pair of spaced apart arms each terminating at a free end, each of said arms of said pincer bar having a twist forming a generally planar end portion between the twist and free end of the respective arm of said pincer bar, said arms of said pincer bar being extended between said cleats, said end portions being inserted into said grooves of said cleats, said lip of said neck of said beverage bottle being positioned between said end portions and said top member adjacent said end portions such that said end portions of said pincer bar hold said neck of said beverage bottle to upper end of said conduit.

9. The toy rocket launcher of claim 8, further comprising an annular washer being disposed around said upper end of said conduit and interposed between said neck of said beverage bottle and said one threaded nut to provided a generally air tight seal between said conduit and said beverage bottle.

10. A toy rocket launcher, comprising:

a support stand having a generally planar top member and a plurality of support legs downwardly depending from said top member;

said top member of said support stand being generally rectangular and having a plurality of corners, a support leg of said support stand being positioned adjacent each corner of said top member;

each of said support legs having a longitudinal axis extending at an obtuse angle from said top member;

each of said support legs terminating at a lower foot tab adapted for resting on a surface, each lower foot tab having a hole therethrough adapted for extending a fastener therethrough to secure the lower foot tab to the surface;

said top member having a hole therethrough, said hole of said top member being centrally positioned on said top member, said hole of said top member having a generally circular periphery;

a conduit having open upper and lower ends;

said conduit being generally L-shaped and having upper and lower portions, said upper and lower portions of said conduit each having a longitudinal axis extending generally perpendicular to one another;

said conduit having a threaded region adjacent said upper end of said conduit, said upper end of said conduit being upwardly extended through said hole of said top member such that said upper end of said conduit upwardly extends from said top member and said lower end of said conduit is positioned below said top member;

a pair of threaded nuts being threaded on to said threaded region of said conduit, said top member being interposed between said threaded nuts such that said conduit is coupled to said top member;

a flexible hose having a pair of open ends, a first of said ends of said hose being coupled to said lower end of said conduit to fluidly connect said hose to said conduit;

a second of said ends of said hose having a valve for selectively opening and closing said second end of said hose;

a pneumatic pump being detachably attached to said second end of said hose for pumping air into said hose;

a beverage bottle, having a neck terminating at an opening into said beverage bottle, said neck of said beverage bottle having an annular lip extending radially outwards there around;

said upper end of said conduit being removably inserted into said opening of said neck of said beverage bottle such that said beverage container is in fluid communication with said conduit;

a pair of spaced apart cleats upwardly extending from said top member, said hole of said top member being interposed between said cleats such that said upper end of said conduit is located between said cleats;

wherein a pair of threaded fasteners couple said cleats to said top member, one of said threaded fasteners extending into said top member and one of said cleats, and another of said threaded fasteners extending into said top member and another of said cleats;

each of said cleats having an elongate groove, said grooves of said cleats facing one another, said grooves having longitudinal axes generally parallel to one another and lying in a plane positioned above said upper end of said conduit and said annular lip of said neck of said beverage bottle and generally parallel to said top member;

a pincer bar being generally U-shaped and having a pair of spaced apart arms each terminating at a free end;

each of said arms of said pincer bar having a twist forming a generally planar end portion between the twist and free end of the respective arm of said pincer bar, each of said end portions having a length defined between the associated twist and free end of the respective arm, said lengths of said end portions of said arms being generally equal to one another, wherein said length of each of said end portions of said arms is about 6 inches;

said end portions of said arms lying in a generally common plane;

said arms of said pincer bar being extended between said cleats, said end portions being inserted into said grooves of said cleats, one of said end portions being inserted into one of said grooves, another of said end portions being inserted into another of said grooves;

said lip of said neck of said beverage bottle being positioned between said end portions and said top member adjacent said end portions such that said end portions of said pincer bar hold said neck of said beverage bottle to upper end of said conduit; and an annular washer being disposed around said upper end of said conduit and interposed between said neck of said beverage bottle and said one threaded nut to provided a generally air tight seal between said conduit and said beverage bottle.

* * * * *